US011999559B2

(12) United States Patent
Brabbs et al.

(10) Patent No.: US 11,999,559 B2
(45) Date of Patent: Jun. 4, 2024

(54) APPARATUS AND METHOD FOR PROTECTIVELY COVERING TEMPERATURE SENSITIVE PRODUCTS

(71) Applicant: Cold Chain Technologies, LLC, Franklin, MA (US)

(72) Inventors: Noel Stephen Brabbs, Garnich (LU); Alain Weimerskirch, Contern (LU)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 16 days.

(21) Appl. No.: 16/101,104

(22) Filed: Aug. 10, 2018

(65) Prior Publication Data

US 2020/0047993 A1 Feb. 13, 2020

(51) Int. Cl.
*B65D 90/06* (2006.01)
*B65D 81/38* (2006.01)
(Continued)

(52) U.S. Cl.
CPC ..... *B65D 90/06* (2013.01); *B65D 81/3888* (2013.01); *B65D 88/14* (2013.01);
(Continued)

(58) Field of Classification Search
CPC .... B65D 90/06; B65D 81/3888; B65D 25/34; B65D 25/36; B65D 65/02; B65D 65/08; B65D 65/10; B65D 11/105; B65D 11/1866; B65D 33/24; B65D 51/12; B65D 51/06; B65D 65/04; B65D 65/06; B65D 65/00
(Continued)

(56) References Cited

U.S. PATENT DOCUMENTS 3,081,519 A 3/1963 Blades et al.
3,169,899 A 2/1965 Steuber
(Continued)

FOREIGN PATENT DOCUMENTS

AU 705627 B2 5/1999
CA 2371456 C 4/2009
(Continued)

OTHER PUBLICATIONS

International Search Report dated Aug. 20, 2019 for corresponding International Application No. PCT/US19/34296, filed on May 29, 2019.
(Continued)

*Primary Examiner* — Robert Poon
(74) *Attorney, Agent, or Firm* — KRIEGSMAN & KRIEGSMAN

(57) ABSTRACT

A system for protecting temperature sensitive products. The system comprises a cover that fits over a product. The cover has a first component, a second component, and a closure system. The first component covers the top of the product and at least a portion of a first side of the product, and the second component covers at least a portion of the other sides of the product. The closure system closes openings between the first component and the second component and tightens the cover around the product. The cover is removable from the product by releasing the closure system and pulling the second component of the cover in a horizontal or downward direction away from the first side of the product.

24 Claims, 9 Drawing Sheets

(51) Int. Cl.
*B65D 88/14* (2006.01)
*B65D 88/74* (2006.01)
*B65D 90/00* (2006.01)

(52) U.S. Cl.
CPC ..... *B65D 88/744* (2013.01); *B65D 90/004* (2013.01); *B65D 2543/00324* (2013.01); *B65D 2590/0066* (2013.01)

(58) Field of Classification Search
USPC ..... 150/154, 165; 229/210, 211, 240
See application file for complete search history.

(56) References Cited

U.S. PATENT DOCUMENTS 3,227,784 A 1/1966 Blades et al.
3,371,815 A * 3/1968 Macomber ..... B65D 9/20 220/1.5
3,659,641 A 5/1972 Marino
3,851,023 A 11/1974 Brethauer et al.
3,950,789 A 4/1976 Konz et al.
4,000,815 A 1/1977 Wingbro et al.
4,179,950 A * 12/1979 Valley ..... B62D 1/06 150/154
4,311,022 A 1/1982 Hall
4,324,111 A 4/1982 Edwards
4,377,075 A 3/1983 Russo
4,399,668 A 8/1983 Williamson
4,413,481 A 11/1983 Thomas
4,442,162 A 4/1984 Kuester
4,585,003 A 4/1986 Meistrell
4,676,247 A 6/1987 Van Cleve
4,688,572 A 8/1987 Hubbard et al.
4,700,706 A 10/1987 Muench
4,846,176 A 7/1989 Golden
4,892,226 A 1/1990 Abtahi
H000759 H 4/1990 Jones
4,986,089 A 1/1991 Raab
4,989,418 A 2/1991 Hewlett
5,005,374 A 4/1991 Spitler
5,020,711 A 6/1991 Kelley
5,024,259 A * 6/1991 Treadway ..... A63B 55/406 150/159
5,088,487 A 2/1992 Turner
5,226,557 A 7/1993 Nelson
5,237,838 A 8/1993 Merritt-Munson
5,270,550 A 12/1993 Martorana et al.
5,304,216 A 4/1994 Wallace
5,305,471 A 4/1994 Steele et al.
5,310,235 A * 5/1994 Seymour ..... B60J 7/104 280/DIG. 5
5,313,809 A 5/1994 Isaacson et al.
5,314,087 A 5/1994 Shea
5,361,603 A 11/1994 Merritt-Munson
5,361,605 A 11/1994 Pizzi et al.
5,409,500 A 4/1995 Dyrek
5,417,082 A 5/1995 Foster et al.
5,595,069 A 1/1997 Gies
5,638,979 A 6/1997 Shea
5,641,325 A 6/1997 Delk et al.
5,669,233 A 9/1997 Cook et al.
5,770,295 A 6/1998 Alderman
5,840,080 A 11/1998 Der Ovanesian
5,857,778 A 1/1999 Ells
5,881,908 A 3/1999 Hays et al.
5,887,437 A 3/1999 Maxim
5,899,088 A 5/1999 Purdum
5,906,290 A 5/1999 Haberkorn
5,934,100 A 8/1999 Hornick
5,950,450 A 9/1999 Meyer et al.
5,953,928 A 9/1999 Saia, III et al.
5,987,910 A 11/1999 Kothe et al.
6,016,664 A 1/2000 Larsson et al.
6,036,047 A 3/2000 Dobbie
6,048,099 A * 4/2000 Muffett ..... A45C 11/20 383/110
6,114,003 A 9/2000 Gottfried
6,116,042 A 9/2000 Purdum
6,128,915 A 10/2000 Wagner
6,223,551 B1 5/2001 Mitchell
6,276,164 B1 8/2001 Santa Cruz et al.
6,325,281 B1 12/2001 Grogan
6,412,545 B1 7/2002 Buff et al.
6,427,761 B1 8/2002 Georges
6,478,061 B2 11/2002 Haberkorn
6,482,332 B1 11/2002 Malach
6,540,085 B1 4/2003 Davies
6,558,608 B2 5/2003 Haraldsson et al.
6,584,797 B1 7/2003 Smith et al.
6,645,598 B2 11/2003 Alderman
6,685,012 B2 2/2004 Bowden et al.
6,832,562 B2 12/2004 Tabor et al.
6,901,711 B2 6/2005 Fay et al.
7,028,504 B2 4/2006 Derifield
7,083,147 B2 8/2006 Movsesian et al.
7,240,513 B1 7/2007 Conforti
7,257,963 B2 8/2007 Mayer
7,310,967 B2 12/2007 Aragon
7,328,583 B2 12/2008 Hillman et al.
7,631,799 B2 12/2009 Turvey et al.
7,641,812 B2 1/2010 Alderman
7,704,584 B2 4/2010 Alderman
7,721,566 B1 5/2010 Wilken
7,766,590 B2 8/2010 Mapitigama et al.
7,819,363 B2 10/2010 Johnson et al.
7,849,708 B2 12/2010 Goncharko et al.
7,913,511 B2 3/2011 Meyer et al.
7,919,163 B2 4/2011 Romero
7,942,618 B1 5/2011 Looker
7,963,397 B2 6/2011 Seagle et al.
8,074,465 B2 12/2011 Heroux et al.
8,141,328 B2 3/2012 Villers et al.
8,156,703 B2 4/2012 Alderman
8,163,363 B2 4/2012 Dummett
8,192,924 B1 6/2012 Barakat et al.
8,224,719 B2 7/2012 Seagle et al.
8,250,835 B2 8/2012 Kenneally
8,292,119 B2 10/2012 Kenneally
8,349,552 B2 1/2013 Haarmann et al.
8,479,801 B2 * 7/2013 Holland ..... E06B 5/00 160/180
8,499,533 B2 * 8/2013 Emond ..... B65D 90/004 53/434
8,505,314 B1 8/2013 Romero
8,580,369 B2 11/2013 Emond et al.
8,607,581 B2 12/2013 Williams et al.
8,672,137 B2 3/2014 Seagle et al.
8,763,423 B2 7/2014 Tattam
8,763,886 B2 7/2014 Hall
8,781,921 B2 7/2014 Seagle et al.
8,887,515 B2 11/2014 Patstone
8,938,986 B2 1/2015 Matta et al.
8,980,397 B2 3/2015 Patberg et al.
9,045,254 B2 6/2015 Davies et al.
9,045,278 B2 6/2015 Mustafa et al.
9,151,531 B2 10/2015 Wengreen et al.
9,366,469 B2 6/2016 Chapman, Jr.
9,429,350 B2 8/2016 Chapman, Jr.
9,689,602 B2 6/2017 Emond et al.
9,707,156 B2 7/2017 Wengreen et al.
9,814,651 B2 11/2017 Wengreen et al.
9,827,529 B2 11/2017 Rebouillat et al.
9,839,873 B2 12/2017 Rebouillat et al.
9,877,894 B2 1/2018 Wengreen et al.
9,889,964 B2 2/2018 Emond et al.
9,913,777 B2 3/2018 Wengreen et al.
9,944,449 B2 4/2018 Wood et al.
9,956,140 B2 5/2018 Wengreen et al.
9,957,099 B2 5/2018 White et al.
9,981,797 B2 5/2018 Aksan et al.
10,583,978 B2 3/2020 Longley et al.
10,604,326 B2 3/2020 Longley et al.
2002/0043218 A1 4/2002 Butler

(56) References Cited

U.S. PATENT DOCUMENTS

| | | | | |
|---|---|---|---|---|
| 2002/0096445 | A1 | 7/2002 | Austin et al. | |
| 2002/0147242 | A1 | 10/2002 | Salyer et al. | |
| 2002/0164474 | A1 | 11/2002 | Buckley | |
| 2002/0185403 | A1 | 12/2002 | Russo | |
| 2003/0124318 | A1 | 7/2003 | Magill et al. | |
| 2003/0163182 | A1 | 8/2003 | Hickey | |
| 2004/0074936 | A1* | 4/2004 | McDonald | A45C 11/20 224/148.5 |
| 2004/0231346 | A1 | 11/2004 | Smith et al. | |
| 2004/0244413 | A1 | 12/2004 | Trinh et al. | |
| 2005/0171812 | A1* | 8/2005 | Garfinkle | G06Q 99/00 220/1.5 |
| 2007/0001055 | A1 | 1/2007 | Smetannikov et al. | |
| 2007/0051734 | A1 | 3/2007 | Kuhn | |
| 2008/0066490 | A1 | 3/2008 | Santeler | |
| 2008/0138182 | A1 | 6/2008 | Johnson et al. | |
| 2008/0290086 | A1 | 11/2008 | Caterina et al. | |
| 2009/0230138 | A1 | 9/2009 | Williams et al. | |
| 2009/0258180 | A1 | 10/2009 | Goulet | |
| 2009/0288980 | A1 | 11/2009 | Hadala | |
| 2010/0037563 | A1 | 2/2010 | Luyten | |
| 2010/0301057 | A1 | 12/2010 | Tattam et al. | |
| 2010/0314397 | A1 | 12/2010 | Williams et al. | |
| 2011/0079330 | A1 | 4/2011 | Raine et al. | |
| 2011/0179807 | A1 | 7/2011 | Holloway et al. | |
| 2011/0185682 | A1 | 8/2011 | Rockwell et al. | |
| 2011/0186473 | A1 | 8/2011 | Rockwell et al. | |
| 2011/0248038 | A1 | 10/2011 | Mayer | |
| 2011/0290792 | A1 | 12/2011 | Krzak et al. | |
| 2012/0261278 | A1 | 10/2012 | Mandzsu et al. | |
| 2013/0015184 | A1 | 1/2013 | Ake et al. | |
| 2013/0015191 | A1 | 1/2013 | Seagle et al. | |
| 2013/0015192 | A1 | 1/2013 | Seagle et al. | |
| 2013/0034732 | A1 | 2/2013 | Parker et al. | |
| 2013/0062355 | A1 | 3/2013 | Shulman | |
| 2013/0213977 | A1 | 8/2013 | Stathes et al. | |
| 2013/0255306 | A1 | 10/2013 | Mayer | |
| 2013/0289680 | A1 | 10/2013 | Hasegawa | |
| 2013/0291584 | A1 | 11/2013 | Chapman, Jr. | |
| 2014/0087105 | A1 | 3/2014 | Formato | |
| 2014/0138281 | A1 | 5/2014 | Emond et al. | |
| 2014/0174692 | A1 | 6/2014 | Emond et al. | |
| 2014/0190976 | A1 | 7/2014 | Imbrecht | |
| 2014/0230976 | A1 | 8/2014 | Davies et al. | |
| 2014/0260107 | A1* | 9/2014 | Conti | B65D 65/00 53/461 |
| 2014/0290285 | A1 | 10/2014 | Formato et al. | |
| 2014/0311170 | A1 | 10/2014 | Mills et al. | |
| 2014/0331711 | A1 | 11/2014 | Blezard et al. | |
| 2014/0343493 | A1 | 11/2014 | Wengreen | |
| 2015/0053086 | A1 | 2/2015 | Rebouillat et al. | |
| 2015/0239639 | A1 | 8/2015 | Wenner et al. | |
| 2015/0276297 | A1 | 10/2015 | Moore et al. | |
| 2015/0285548 | A1 | 10/2015 | Emond et al. | |
| 2015/0367604 | A1 | 12/2015 | Anderson et al. | |
| 2016/0200478 | A1 | 7/2016 | Noe | |
| 2016/0262979 | A1 | 9/2016 | Wengreen et al. | |
| 2016/0362240 | A1 | 12/2016 | Ferracamo, Jr. | |
| 2017/0096283 | A1* | 4/2017 | Longley | F28F 23/00 |
| 2017/0131015 | A1 | 5/2017 | Farrar | |
| 2017/0197752 | A1 | 7/2017 | Imbrecht et al. | |
| 2018/0036202 | A1 | 2/2018 | Wengreen et al. | |
| 2018/0093816 | A1 | 4/2018 | Longley et al. | |
| 2018/0320947 | A1 | 11/2018 | Jain et al. | |
| 2019/0331389 | A1* | 10/2019 | Cummings | B65D 25/40 |

FOREIGN PATENT DOCUMENTS

| | | | |
|---|---|---|---|
| CN | 104781159 | A | 7/2015 |
| DE | 7918679 | U1 | 10/1979 |
| DE | 8801345 | U1 | 3/1988 |
| DE | 202007014283 | U1 | 1/2008 |
| DE | 102008004485 | A1 | 7/2009 |
| EP | 1006058 | A1 | 6/2000 |
| EP | 1534608 | A1 | 6/2005 |
| EP | 2157024 | A1 | 2/2010 |
| FR | 2928354 | A1 | 9/2009 |
| FR | 2989359 | A1 | 10/2013 |
| FR | 2994420 | A1 | 2/2014 |
| GB | 2418413 | B | 3/2008 |
| GB | 2448469 | A | 10/2008 |
| GB | 2452059 | A | 2/2009 |
| GB | 2476110 | A | 6/2011 |
| GB | 2559451 | A | 8/2018 |
| JP | H02232291 | A | 9/1990 |
| JP | 2001180767 | A | 7/2001 |
| JP | 2011046399 | A | 3/2011 |
| KR | 101507398 | B1 | 10/2012 |
| WO | 9843028 | A1 | 10/1998 |
| WO | 03073030 | A1 | 9/2003 |
| WO | 2004020311 | A1 | 3/2004 |
| WO | 2005007519 | A2 | 1/2005 |
| WO | 2005075307 | A1 | 8/2005 |
| WO | 2006043092 | A1 | 4/2006 |
| WO | 2009024804 | A1 | 2/2009 |
| WO | 2009140194 | A1 | 11/2009 |
| WO | 2013025827 | A1 | 2/2013 |
| WO | 2014070167 | A1 | 5/2014 |
| WO | 2014083320 | A1 | 6/2014 |
| WO | 2014113035 | A1 | 7/2014 |
| WO | 2014118821 | A1 | 8/2014 |
| WO | 2014185925 | A1 | 11/2014 |
| WO | 2015097788 | A1 | 7/2015 |
| WO | 2016171539 | A1 | 10/2016 |
| WO | 2017062675 | A2 | 4/2017 |
| WO | 2017072638 | A1 | 5/2017 |
| WO | 2017220953 | A1 | 12/2017 |
| WO | 2017220954 | A1 | 12/2017 |
| WO | 2018142133 | A1 | 8/2018 |
| WO | 2018167478 | A1 | 9/2018 |
| WO | 2018213348 | A2 | 11/2018 |

OTHER PUBLICATIONS

Energy Shield Insulated Pallet Covers' (Steel Guard) Apr. 23, 2015. Retrieved from the Internet on Dec. 6, 2016. URL: https://web.archive.org/web/20150423145914/http://www.steelguardsafety.com/insulated-pallet-covers.

Sales literature entitled "creating solutions: Pallet Thermal Protection System," CAPPI (Competences Associees en Plasturgie et Process Industriels), Auxerre, France (Jan. 2015).

Sales literature for PalletQuilt, Q Products & Services, Hazel Crest, Illinois (2010).

Sales literature for Tyvek cargo covers, E.I.du Pont de Nemours and Company, Wilmington, Delaware (2014).

Sales literature for SilverSkin thermal pallet covers, TP3 Global, Redditch, West Midlands, UK (2017).

Sales literature for Polar Tech insulated pallet covers, Polar Tech Industries, Inc., Genoa, Illinois (2015).

Literature for PalletQuilt Shipping System, Summer Packout, Cold Chain Technologies, Holliston, MA (2013).

Spec sheets for GoodCape Standard, GoodCape Light and GoodCape Extreme laminates, Trip & Co., Nieuw-Vennep, The Netherlands (2016).

BusinessWire article entitled "Cold Chain Technologies Responds to Envirotainer's Resized RKN 12 Pallet Shipper," (2009); https://www.businesswire.com/news/home/20090306005069/en/Cold-Chain-Technologies-Responds-Envirotainers-Resized-RKN.

Sales literature for Envirotainer RKN t2 container, Envirotainer AB, Stockholm, Sweden (2018); https://www.envirotainer.com/en/active-containers/our-container-products/envirotainer-rkn-t2/.

Sales literature for KoolTemp insulated pallet container—ZX4500, Cold Chain Technologies, Inc., Holliston, Massachusetts (2009).

Sales literature for Foam Fabricators Airdex pallet, Scottsdale, Arizona (2018); http://www.foamfabricatorsinc.com/Page.aspx?nid=103.

Sales literature for Trip & Co. GoodCape thermal cover (2018); https://www.trip-co.nl/aircargo/products/insulation-cover/.

(56) References Cited

OTHER PUBLICATIONS

Sales literature for DuPont Tyvek air cargo covers for pharmaceuticals, E.I. du Pont de Nemours and Company, Wilmington, Delaware (2014).
Sales literature for CooLiner, accessed on Oct. 5, 2018 at https://ipcpack.com/pdf/cooliner-brochure.pdf, Insulated Products Corp. Rancho Dominguez, California.
"Solar Reflectivity (R) & Solar Reflectance Index (SRI) by Color," Dean Steel Buildings, Inc., 2016; retrieved from the Internet on Feb. 22, 2021; https://www.deansteelbuildings.com/products/panels/sr-sri-by-color/.
"Heat Island Group Definitions and Terms," Berkeley Lab, 2021; retrieved from the Internet on Feb. 22, 2021; https://heatisland.lbl.gov/resources/definitions-and-terms.
"Tour of the Electromagnetic Spectrum," NASA, 2021; retrieved from the Internet on Feb. 22, 2021;https://science.nasa.gov/ems/08_nearinfraredwaves.
"R-value (insulation)," Wikipedia, 2021; retrieved from the Internet on Feb. 22, 2021; https://en.wikipedia.org/wiki/R-value_(insulation).
International Preliminary Report on Patentability dated Feb. 16, 2021, in corresponding PCT Application No. PCT/US2019/034296.
United States Statutory Invention Registration No. H759, inventor Jones, published Apr. 3, 1990.

* cited by examiner

APPARATUS AND METHOD FOR PROTECTIVELY COVERING TEMPERATURE SENSITIVE PRODUCTS

FIELD

Disclosed embodiments relate generally to an apparatus and method for covering and protecting a product, and more particularly to an apparatus and method for covering and protecting temperature sensitive products between and during transport.

BACKGROUND

Perishable and temperature sensitive products such as vaccines, pharmaceuticals and diagnostic products, and horticultural produce, deteriorate rapidly when the temperature goes above or below certain values by even a few degrees and are, therefore, sensitive to poor temperature management experienced during transportation. Shipping methods for such products have weak points where the products are transferred between temperature controlled locations or from one means of transport to another. For instance, air cargo is held on the airport runway or ramp while awaiting loading onto an aircraft. Airport ground handlers and airlines attempt to minimize the time required to transport temperature sensitive goods to and from aircraft, but it is not always practical to do this as ramp exposure times can reach up to 4 hours. In extreme environments—for example, those with high or low temperatures, or strong sunlight—even a few minutes of exposure can lead to an excursion outside recommended conditions. This can affect the quality and, for pharmaceutical products, the regulatory status of such products if temperature excursions occur outside the temperature range declared in the product license for the destination country or identified by product stability data.

Air cargo is generally transported on special aircraft pallets or containers known as Unit Load Devices or ULDs. These are standardized pallets or containers which are designed to 'unitize' cargo which may be received by an airline in many different forms but which need to be handled inside an aircraft in a safe and uniform way. For instance, boxed goods are typically stacked on and secured to wooden pallets (commonly referred to as 'skids' in the air cargo industry) which exist in a variety of sizes depending on the type of product and country. For aircraft loading, a number of these skids (typically four to six) are placed on a metallic airline pallet and the entire load is retained with a cargo net tightened over the whole, and secured to the edges of the airline pallet with special clamps. Those skids can then be transported at the departure, arrival, and any intermediate airport as a single unit, using standardized equipment. Other kinds of ULDs are containers, usually made from aluminum in standard sizes and shapes, into which loose cargo can be loaded so that it can be easily moved around airports using the same, standardized equipment. ULDs can also be positioned easily inside the cargo hold of most modern aircraft by means of rollers embedded in the floor, and can be clamped in place to secure the cargo for flight, again using standardized devices. The use of ULDs such as airline pallets with cargo nets is an important safety feature mandated by international aviation regulations, to prevent cargo from shifting within the hold during flight and potentially upsetting the balance and stability of the aircraft. Their use is also required on the ground to prevent any cargo items or packaging materials from becoming loose on the airport runway where they could pose a hazard to aircraft during taxi, take-off, or landing. This last hazard is of such concern that most airports severely restrict, or even completely forbid, the use of any kind of external weather protection such as cargo covers when loads are being moved around the airport, unless such cargo covers are installed under the cargo net. In such cases, it is impossible to open the cargo net to remove the cargo covers during or after loading due to space and time restrictions, so the cargo covers have to fly with the cargo, and this makes their re-use impractical and limits their performance to a level which is affordable in a single use design.

Reusable cargo covers do exist, but they are heavy, bulky, stiff, and have complicated closure systems such as buckles, ties, and straps, making them challenging to use for airport cargo. For instance, the heaviness of existing reusable cargo covers makes them difficult to manipulate and transport by operators working in the ground handling environment and the bulkiness makes them impossible to remove in confined spaces such as inside or at the entrance to an aircraft. This is true for reusable covers designed for lower cargo deck ULDs that are limited in height to about 1.6 m. It is even more pertinent for upper deck ULDs which can be up to 3 m in height, adding considerable bulk and weight to a cover, and also requiring a ladder or equivalent to access the top of the load so that an operator can remove it from the airline pallet. Moreover, the complicated closure systems of the existing reusable cargo covers are difficult to unfasten—slowing down the cargo loading operation—and difficult to ensure that they are closed when fitting the covers, resulting in openings that compromise their performance.

Accordingly, there is a need and desire for an improved apparatus and method that provides thermal protection to temperature sensitive products during transport to an aircraft while minimizing hazards or delays in ramp handling operations.

SUMMARY

In one aspect, the present disclosure provides a system for protecting temperature sensitive products. The system comprises a cover that fits over a product. The cover has a first component, a second component, and a closure system. The first component covers the top of the product and at least a portion of a first side of the product. The second component covers at least a portion of the other sides of the product. The closure system closes openings between the first component and the second component and tightens the cover around the product. The cover is removable from the product by releasing the closure system and pulling the second component of the cover in a horizontal or downward direction away from the first side of the product.

In one embodiment, the first component covers the entire first side of the product and the second component covers the entire other sides of the product. In another embodiment, the first component and the second component contain flaps that create an overlap between the first component and the second component on a portion of the first side of the product and a portion of the other sides of the product. The first component and the second component are fixed to each other at points between or at the seam of the overlap on a portion of the other sides of the product. In another embodiment, the first side of the product contains a contoured edge.

In one embodiment, the closure system is positioned along a first opening at one vertical edge of the first component and along a second opening at the other vertical edge of the first component. In another embodiment, the closure system along the first opening includes a first rope alternately threaded in a zigzag-like pattern between first rings positioned on the first component and on the second component, and the closure system along the second opening includes a second rope alternately threaded in a zigzag-like pattern between second rings positioned on the first component and on the second component. In another embodiment, at least some of the first rings within the top 25% and the bottom 25% of all of the first rings are spaced closer together vertically than the other first rings and at least some of the second rings within the top 25% and the bottom 25% of all of the second rings are spaced closer together vertically than the other second rings.

In one embodiment, the first rings and the second rings are attached to the cover with non-elastic ropes that pass through grommets placed in or around holes in the first component and the second component. In another embodiment, the length of each non-elastic rope and the location of each grommet that each non-elastic rope passes through is such that, when the first rope and the second rope of the closure system are interlaced and under tension, the grommets are no less than about 5 cm from the one vertical edge of the first component and the other vertical edge of the first component.

In one embodiment, the first rope and the second rope comprise a non-elastic section and an elastic section. The elastic section is located within the bottom 30% of the first rope and within the bottom 30% of the second rope.

In one embodiment, the first component and the second component of the cover have a nominal basis weight of no greater than about 600 gsm. In another embodiment, the cover has a total weight of less than about 35 kg.

In one embodiment, the first component and the second component comprise a polyolefin. In another embodiment, the polyolefin is a nonwoven flash spun plexifilamentary sheet of polyethylene. In another embodiment, the first component and the second component have a solar reflectivity of at least 90% in the visible and near infra-red range. In another embodiment, the first component and the second component of the cover further comprise a fleece with an R-value of about 0.3 m2K/W.

In another aspect, the present disclosure also provides a system for protecting temperature sensitive products comprising a cover that fits over a cuboid-shaped cargo that has a contoured edge on its front side. The cover has a lid component and a lateral component that are fixed to each other, and a closure system. The lid component covers the top of the cargo and the front side of the cargo. The lateral component covers the sides of the cargo adjacent to the front side of the cargo and the rear side of the cargo. The closure system closes openings between the lid component and the lateral component and tightens the cover around the cargo. The cover is removable from the cargo by releasing the closure system and pulling the lateral component of the cover in a horizontal or downward direction away from the front side of the cargo.

In another aspect, the present disclosure also provides a method for utilizing a protective cover. The method comprises placing a cover over a product. The cover has a first component, a second component, and a closure system. The first component covers the top of the product and at least a portion of a first side of the product. The second component covers at least a portion of the other sides of the product. The method also comprises closing openings in the cover between the lid component and the lateral component and tightening the cover around the product with the closure system, releasing the closure system, and removing the cover from the product by pulling the second component of the cover in a horizontal or downward direction away from the first side of the product.

In one embodiment, the method step of closing openings in the cover and tightening the cover around the product with the closure system comprises attaching the top end of a rope to a topmost ring of a plurality of rings in the closure system along one opening at one vertical edge of the lid component and alternately threading the rope through the plurality of rings between the lid component and the lateral component from top to bottom. The plurality of rings are attached to the cover by a non-elastic rope. The method step also comprises tensioning the rope and locking the bottom end of the rope to the bottommost ring, and repeating the preceding steps on the closure system along the other opening at the opposite vertical edge of the lid component.

In one embodiment, the method step of releasing the closure system comprises detaching the bottom end of a rope from the bottommost ring of a plurality of rings in the closure system along one opening at one vertical edge of the lid component, unthreading the rope through two or more of the plurality of rings, at least partially pulling the lid component and lateral component apart along one opening at one vertical edge of the lid component, repeating the preceding steps on the closure system along the other opening at the opposite vertical edge of the lid component.

DETAILED DESCRIPTION

Figure 1A:
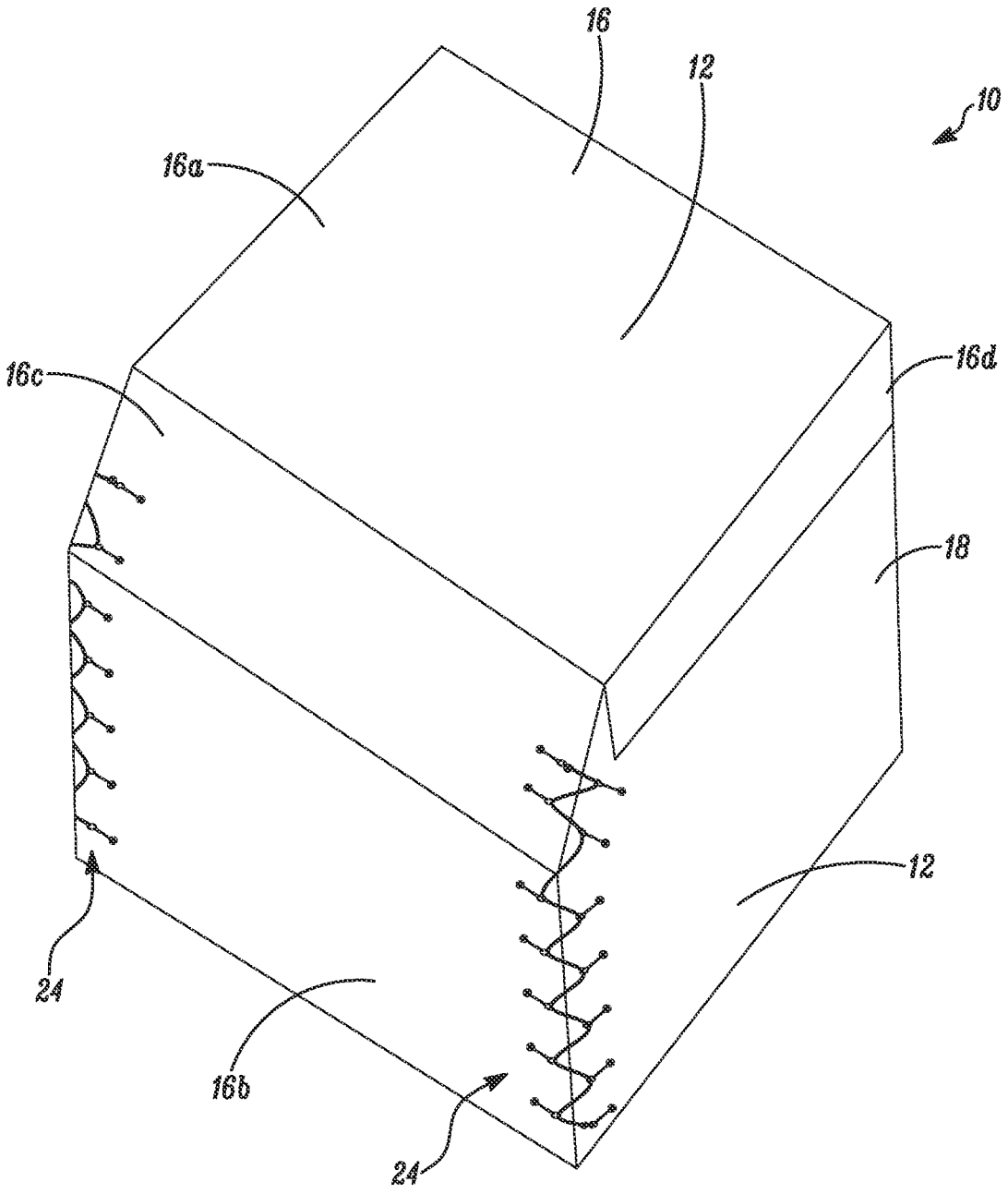
FIG. 1A is a front perspective view of a system for protecting temperature sensitive products according to an exemplary embodiment of the invention.

In the following detailed description, reference is made to the accompanying drawings which form a part hereof, and which illustrate specific embodiments of the invention. These embodiments are described in sufficient detail to enable those of ordinary skill in the art to make and use them. It is also understood that structural, logical, or procedural changes may be made to the specific embodiments disclosed herein without departing from the spirit or scope of the invention.

The system for protecting temperature sensitive products disclosed herein provides a cover with openings and a closure system that facilitate easy removal of the cover by workers below or on the same level as the cargo or product by sliding the cover off the cargo or product horizontally and/or downward rather than having to lift the cover up vertically to remove it from the cargo or product. The cover is also sufficiently lightweight, compressible, and flexible such that it can be removed from the cargo or product inside tight spaces, removed by one or two persons, folded after use, and easily transported back to its place of origin for reuse.

Cargo Cover

FIGS. 1A, 1B, 1C and 2 illustrate perspective views and an exploded view of a system for protecting temperature sensitive products according to exemplary embodiments of the invention. The system 10 comprises a cover 12 that covers cargo or products 14. The terms "cargo" and "products," as used herein, may include the actual cargo or products themselves and/or the material(s) surrounding and/or holding the cargo or products.

As shown in FIGS. 1A, 1B, 1C and 2, the cover 12 is configured to fit over the cargo 14 which is cuboid-shaped with an additional contoured edge on one of its sides. To maximize use of space in an aircraft, the cargo is commonly shaped such that there is a contoured edge on one of its sides toward the top of the cargo 14 (see, e.g., 14*c* in FIG. 2). However, in some embodiments, the system may be used for protecting products held or transported on a pallet, skid, or base, or in any kind of storage or transportation device/unit, ULD, container, carrier, object, etc., of any shape or size, and the cover 12 may be adapted and configured to fit any such shape or size.

The cover 12 has two separate components: a lid component 16 and a lateral component 18. The lid component 16 covers the top of the cargo 14*a* and at least a portion of a first side of the cargo 14: 14*b* and 14*c*. Lid component section 16*a* covers the top of the cargo 14*a* and lid component sections 16*b* and 16*c* cover at least a portion of the first side of the cargo 14 (i.e., 14*b* and 14*c*). Preferably, the lid component 16 covers the entire first side of the cargo 14 (i.e., 14*b* and 14*c*).

Figure 1B:
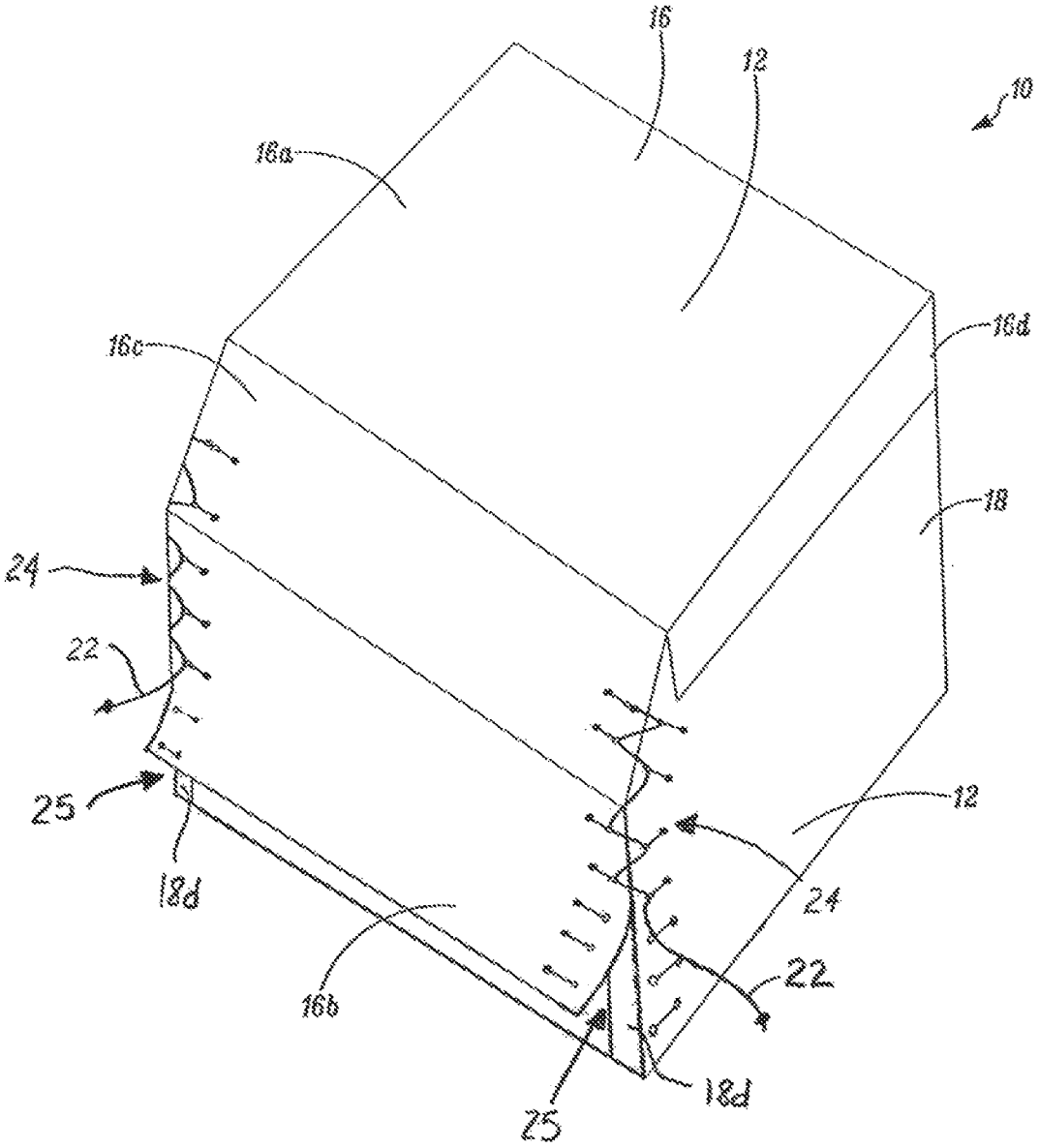
FIG. 1B is a perspective view of the system of FIG. 1A, with the lid component and the lateral component partially separated from one another to reveal openings therebetween.
Figure 1C:
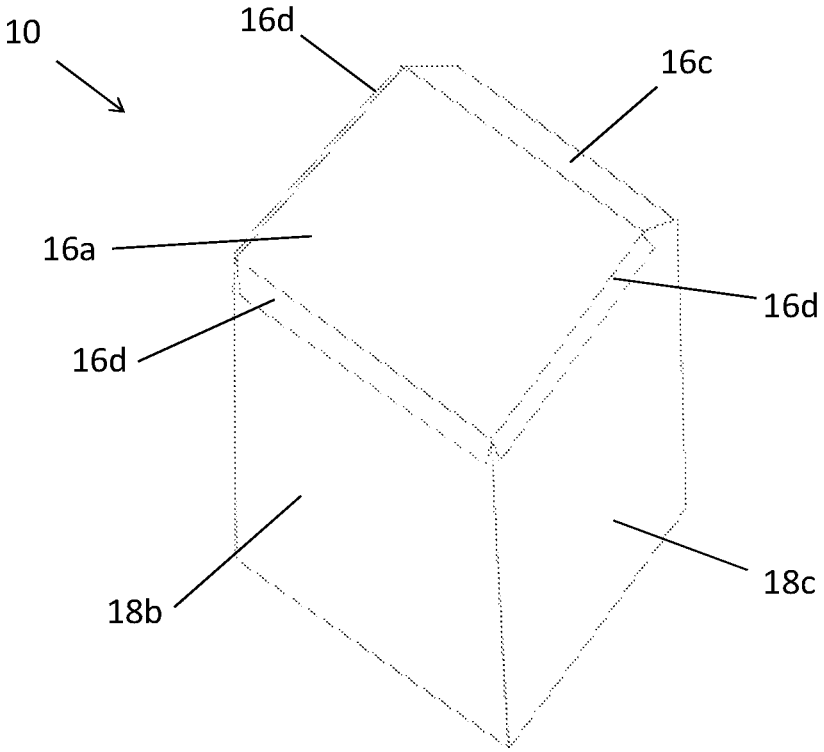
FIG. 1C is a simplified rear perspective view of the system of FIG. 1A, with the details of the closure system not shown.
Figure 2:
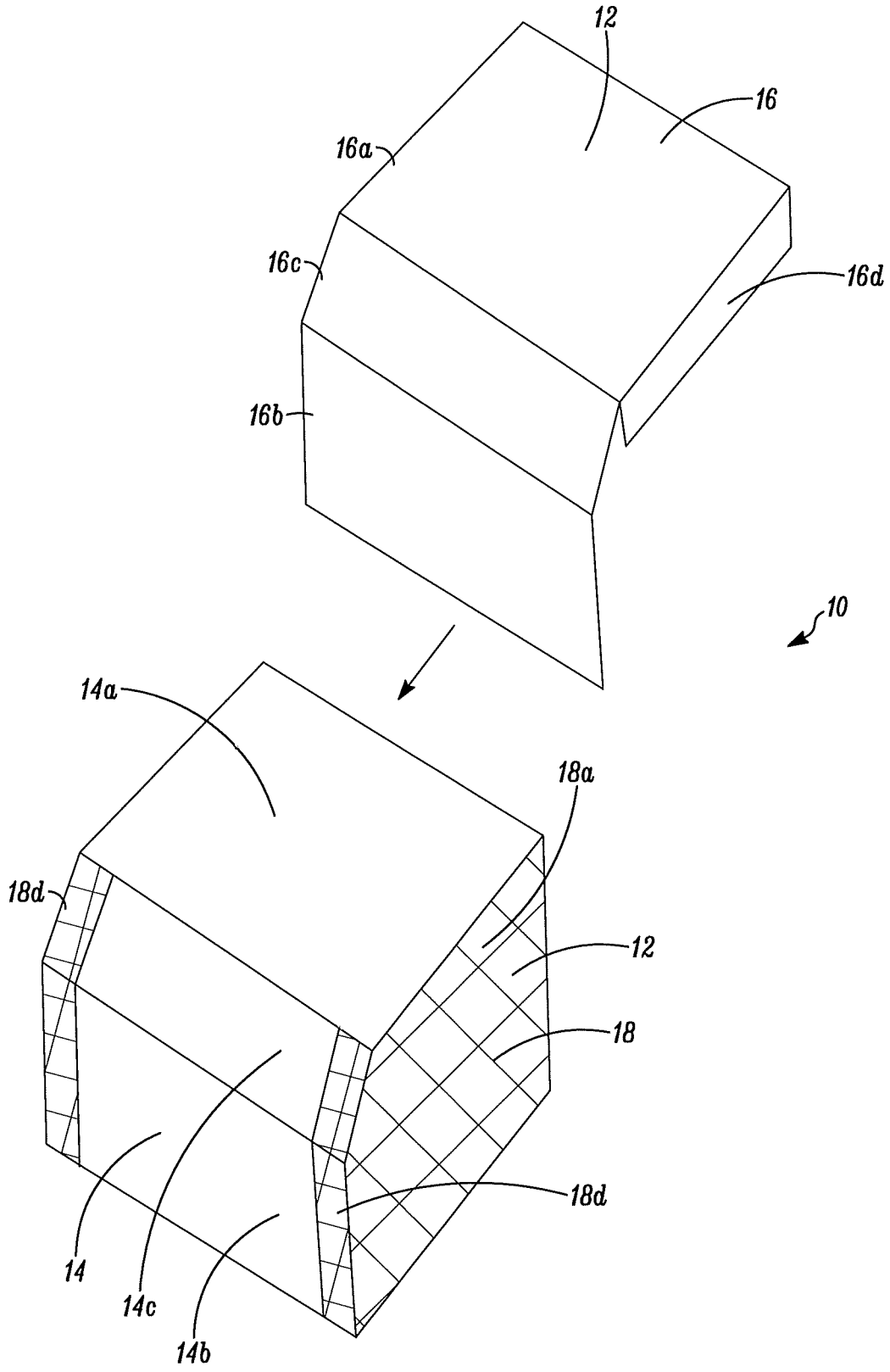
FIG. 2 is an exploded view of a system for protecting temperature sensitive products according to the exemplary embodiment of the invention.

The lid component 16 includes flaps 16*d* that partially extend from lid component section 16*a* over portions of the lateral component 18—more particularly, portions of sections 18*a*, 18*b*, and 18*c* described below—that cover sides of the cargo 14*d*, 14*e*, and 14*f* (not shown): the sides of the cargo 14 adjacent to the first side of the cargo 14 (i.e., 14*d* and 14*f*) and opposite the first side of the cargo 14 (i.e., 14*e*). In FIGS. 1A, 1B, and 2, only one of the flaps 16*d* is shown whereas, in FIG. 1C, three flaps 16*d* are shown. The width of each flap 16*d* is not particularly limited and may be configured to any suitable width. In some embodiments, the width of each flap 16*d* is from about 100 mm to about 250 mm, in some embodiments it is from about 150 mm to about 200 mm, and in some embodiments it is about 150 mm.

The lateral component 18 covers at least a portion of the sides of the cargo 14*d*, 14*e*, and 14*f*. Lateral component sections 18*a* and 18*c* cover at least a portion of the sides of the cargo 14*d* and 14*f*, which are adjacent to the first side of the cargo 14, and lateral component section 18*b* covers at least a portion of the side of the cargo 14*e*, which is opposite the first side of the cargo 14. Preferably, the lateral component 18 covers the entire sides of the cargo 14*d*, 14*e*, and 14*f*. As shown in FIG. 2, the lateral component 18 also comprises flaps 18*d* that partially cover the first side of the cargo 14*b* and 14*c*. The width of each flap 18*d* is not particularly limited and may be configured to any suitable width. In some embodiments, the width of each flap 18*d* is from about 100 mm to about 250 mm, in some embodiments it is from about 150 mm to about 200 mm, and in some embodiments it is about 150 mm.

The flaps 16*d* and 18*d* create an overlap between the lid component 16 and the lateral component 18 that serves to reduce the ingress of hot or cold air and moisture (e.g., in the case of rain). The lid component 16 and the lateral component 18 are fixed to each other at points between the overlap and/or at the seam of the overlap between flaps 16*d* and lateral component sections 18*a*, 18*b*, and 18*c*. The lid component 16 and the lateral component 18 may be fixed to each other at such points between the overlap and/or at the seam of the overlap permanently or non-permanently, preferably permanently, and may be fixed to each other by any suitable method of attachment known in the art, such as by tape, adhesive, hook and loop fasteners, welding, sewing, etc. The words "covers" and "over" as used throughout this application do not necessarily mean "directly on" or "touching." For instance, the lid component 16 may be located directly on the cargo 14 or, alternatively, an additional layer or layers may be located between the lid component 16 and the cargo 14 such as, but not limited to, a portion of the lateral component 18. As another example, an additional layer or layers may be located between the lateral component 18 and the cargo 14.

In some embodiments, the lid component 16 may cover a non-contoured side of the cargo 14. In some embodiments, the lateral component 18 may cover a contoured side of the cargo 14.

As shown in FIG. 1, the cover 12 includes a closure system 24 positioned generally in a vertical direction near and at the intersection of the lid component sections 16*b* and 16*c* and the lateral component sections 18*a* and 18*c* (i.e., near and at the vertical edges of lid component 16). The closure system 24 closes openings (not shown) in the cover 12 that exist between this intersection of unfixed sections of the lid component 16 (i.e., 16*b* and 16*c*) and the lateral component 18. The closure system 24 may include any suitable user-friendly attachment and detachment means known in the art. In some embodiments, the closure system 24 may extend all the way from the bottom of the lid component section 16*b* or bottom of the lateral component 18, and/or all the way to the top of the contoured lid component section 16*c* or top of lateral component 18. In some embodiments, however, the closure system 24 may be positioned in any suitable direction and location, including, but not limited to, vertically down the center of sections 16*b* and 16*c*.

In some embodiments, the lid component 16 and the lateral component 18—excluding any attachment means, closure system 24 components, etc.—each have a nominal basis weight of no greater than about 600 gsm, in other embodiments no greater than about 500 gsm, in other embodiments no greater than about 350 gsm, and in other embodiments even no greater than 330 about gsm.

In some embodiments, the ready to use cover 12—including any attachment means, closure system 24 components, etc.—has a total weight less than about 35 kg, in other embodiments less than about 30 kg, in other embodiments less than about 25 kg, in other embodiments less than about 20 kg, in other embodiments less than about 15 kg, and in other embodiments less than about 10 kg.

Figure 3:
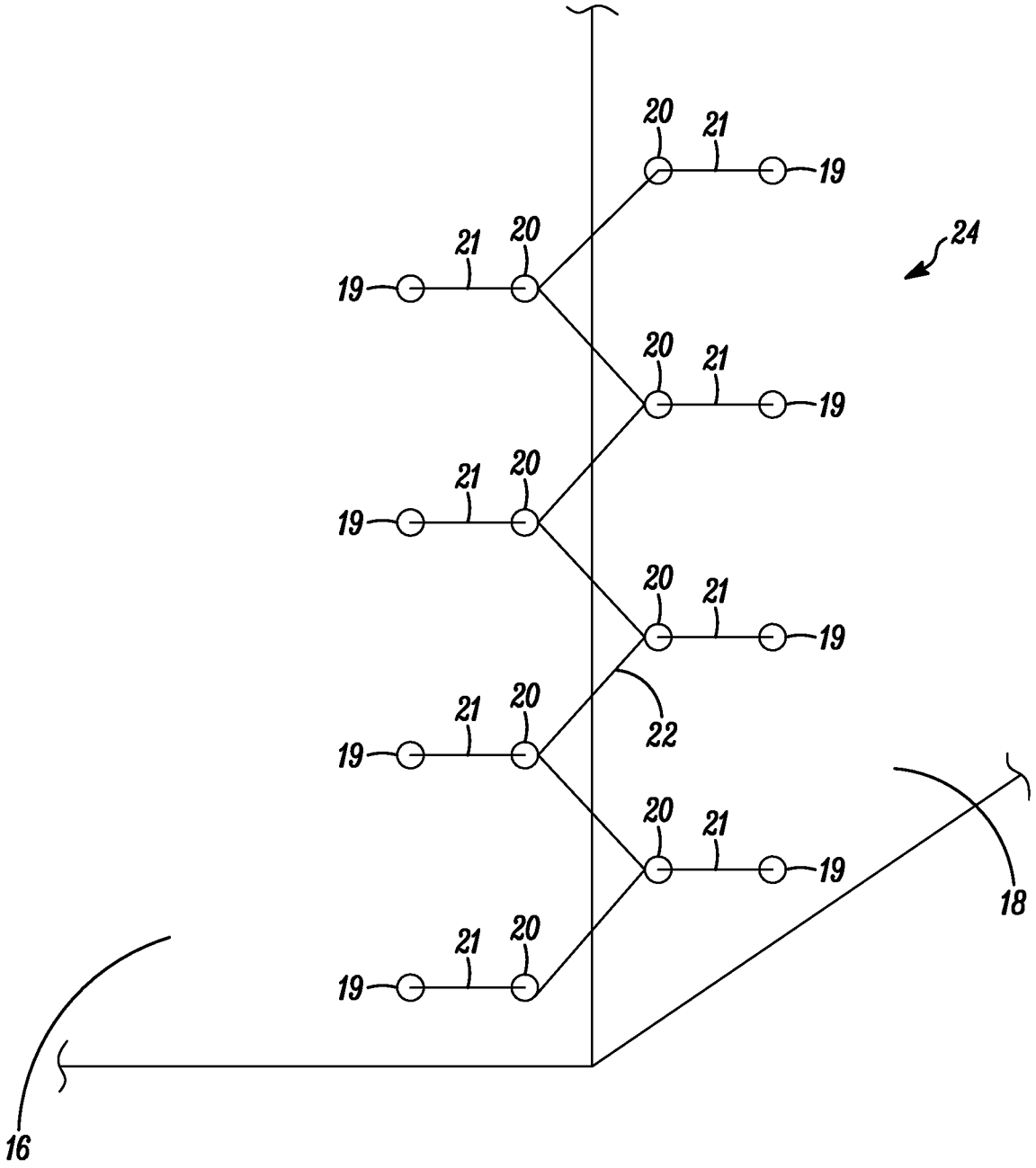
FIG. 3 is a perspective view of a portion of a closure system along one opening at one vertical edge of a lid component according to an exemplary embodiment of the invention.

FIG. 3 illustrates a closure system along one opening at one vertical edge of a lid component according to an exemplary embodiment of the invention. The closure system 24 comprises a rope 22 threaded through a plurality of rings 20. The term "rope," as used herein, includes any suitable type of string-like material known in the art, including, but not limited to, rope, string, twine, lace, tape, ribbon, cord, cable, and variations thereof. The rings 20 are located both on the lid component 16 and the lateral component 18. The topmost ring 20 and the bottommost ring 20 of the closure system 24 along each opening may be on either the lid component 16 or the lateral component 18.

The rope 22 may be constructed from any suitable material known in the art, including, but not limited to, polyethylene, polypropylene, polyester, nylon, polyurethane, natural or synthetic rubber, elastomers, aramid, natural and synthetic fibers such as sisal, jute, and the like, as well as steel, aluminum wire, etc. The diameter of the rope 22 may be any suitable diameter known in the art, including, but not limited to, from about 3 mm to about 15 mm.

The rings 20 may be any suitable type of ring known in the art. Moreover, in some embodiments, hooks, ropes with loops, or any other suitable variation to rings known in the art may be used for rings 20. The rings 20 may be constructed from any suitable material known in the art including, but not limited to, plastic or metals such as nickel-plated steel.

The rope 22 of the closure system 24 is alternately threaded in a zigzag-like pattern from a ring 20 on the lid component 16 to a ring 20 on the lateral component 18, or from a ring 20 on the lateral component 18 to a ring 20 on the lid component 16, until a sufficient number of rings 20 have been threaded. This zigzag shaped threading pattern keeps a tight joint between the lid component 16 and the lateral component 18.

Figure 4:
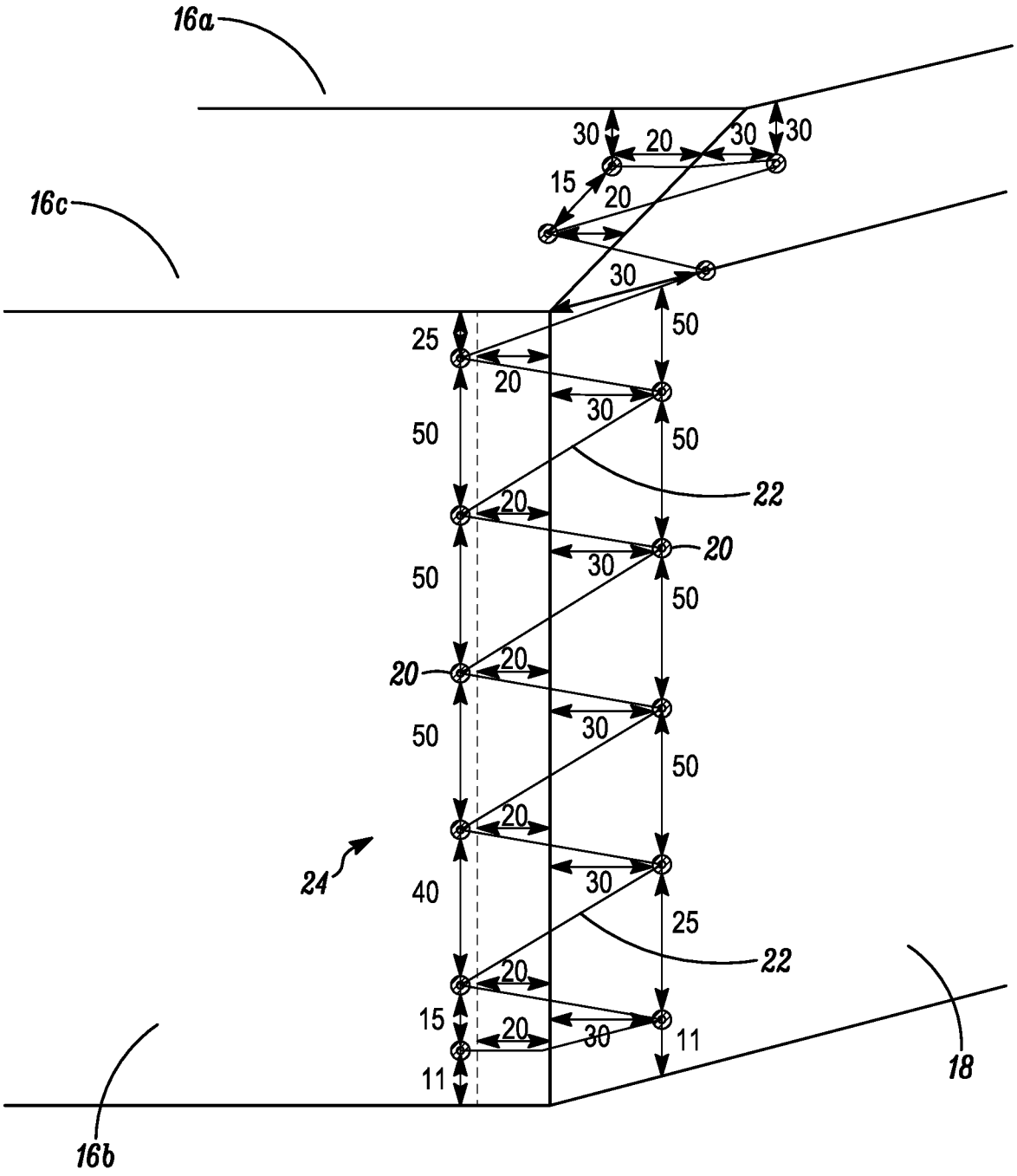
FIG. 4 shows a perspective view of a closure system's ring location and spacing along one opening at one vertical edge of a lid component in a fully threaded and tensioned cover according to an exemplary embodiment of the invention.

The rings 20 may be spaced apart vertically in any suitable manner. In some embodiments, the distance between vertically adjacent rings 20 for both the lid component 16 and the lateral component 18 may vary at different parts of the cover 12. In some embodiments, the distance between at least some of the vertically adjacent rings 20 that are positioned within the top 25% and the bottom 25% of the plurality of rings 20—% measured with respect to the rings 20 along each opening separately—is smaller than the other vertically adjacent rings 20 (hereinafter "intermediate rings"). In some embodiments, the distance between at least some of the vertically adjacent rings 20 that are positioned within the top 15% and the bottom 15% of the plurality of rings 20 is smaller than the vertically adjacent intermediate rings. This allows for a tight and secure closing of the openings between the unfixed sections of the lid component 16 and the lateral component 18. The intermediate rings 20 are spaced further apart vertically to facilitate opening of the closure system 24. For instance, the cover 12 is removed by unfastening the threading rope 22 of the closure system 24 along both openings, one along each vertical edge of the lid component 16, and pulling the lateral component 18 of the cover 12 in a horizontal and/or downward direction away from the first side of the cargo 14. Spacing the vertically adjacent intermediate rings 20 further apart enables operators of short stature, e.g., to release the closure system 24 more easily. They can unthread the rope 22 from the rings 20 as high as they can easily reach. Then pulling apart the lid component 16 and lateral component 18 causes the rope 22 to slide out from the rings 20 that are not easily reachable. Although the rope 22 may still be threaded through some of the upper rings 20 after pulling apart the lid component 16 and the lateral component 18, release of the tension makes it easy for the cover 12 to be opened and removed from the cargo 14. FIG. 4 illustrates the relative spacing of rings 20, measured in cm, in a closure system 24 along one opening at one vertical edge of a lid component 16 of a fully threaded and tensioned cover 12 according to an exemplary embodiment of the invention.

In some embodiments, the rope 22 may comprise a non-elastic section and an elastic section. The total length of elastic section of rope 22 is less than the length of the non-elastic section of rope 22 with final lengths of each being determined by the amount of tension required for each cover 12 to function effectively. In some embodiments, the elastic section of rope 22 is located within the bottom 30% of the rope 22, in other embodiments within the bottom 20% of the rope 22, in other embodiments within the bottom 10% of the rope 22, and in other embodiments within the bottom 5% of the rope 22. In some embodiments, the two sections of rope 22 may be crimped together in a similar manner to the crimping of non-elastic rope 21 as described below and shown in FIG. 6. As the rope 22 comprises elastic rope, the entire rope 22 can be tensioned and pulled tight as or after the rope 22 is threaded through the rings 20.

The ends of the rope 22 may be attachable to the cover 12 by the use of any suitable attachment and detachment means known in the art. In some embodiments, a carabiner may be used as the attachment and detachment means for the ends of the rope 22 of the closure system 24 and the cover 12. One or both ends of the rope 22 may be attached to a carabiner having a size that will permit it to both pass through and hook onto the rings 20. The carabiner(s) may be attached to the first and/or last rings 20 when threading the rope 22 through the rings 20 from the top to bottom. The carabiner may be constructed from any suitable material known in the art including, but not limited to, plastic or metals. In some embodiments, the top end of the rope 22 may be attached to the first ring 20 (i.e., uppermost ring) by forming a loop through the ring 20 with the end of the rope 22. In some embodiments, the top end of the rope 22 may be attached to the first ring 20 by tying the rope 22 to the ring 20 with the end of the rope 22.

Figure 5:
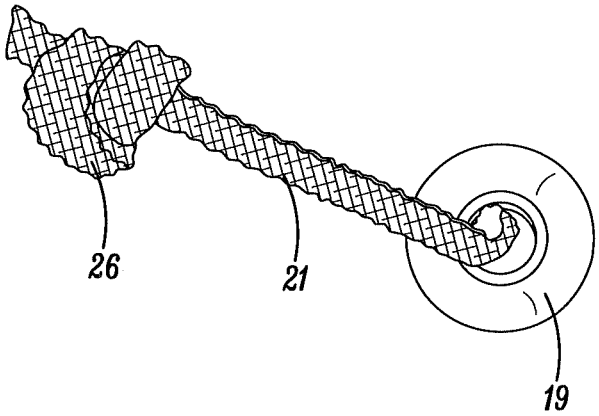
FIG. 5 shows a perspective view of a knot used to lock in place a non-elastic rope of a closure system to a cover according to an exemplary embodiment of the invention.

Referring to FIG. 3, each ring 20 is attached to the lid component 16 or lateral component 18 by a non-elastic rope 21 that is placed through a hole in and secured to the lid component 16 or lateral component 18. The term "rope," as used herein, includes any suitable type of string-like material known in the art, including, but not limited to, rope, string, twine, lace, tape, ribbon, cord, cable, and variations thereof. Grommets 19 may be placed in or around the holes in the lid component 16 and lateral component 18 for additional strength and protection. The non-elastic rope 21 may be locked in place or secured to the lid component 16 or lateral component 18 by any suitable means known in the art, including, but not limited to, knots, a second ring having a diameter greater than the internal diameter of the grommet 19, a locking bar having a length greater than the internal diameter of the grommet 19, etc. For example, in some embodiments, one end of the non-elastic rope 21 passes through a grommet 19 and is knotted on the other side of the grommet 19 such that the knot is of a size larger than the internal diameter of the grommet 19, thus locking the non-elastic rope 21 in place. There may be one or more knots used as a locking means. FIG. 5 shows an example of a knot 26 used to lock in place the non-elastic rope 21 of a closure system 24 to the cover 12 according to an exemplary embodiment of the invention.

Figure 6:
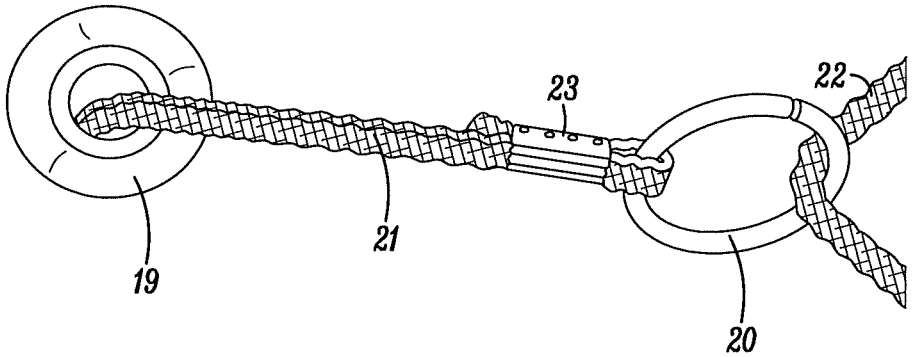
FIG. 6 shows a perspective view of an attachment of a ring to a cover by a non-elastic rope of a closure system according to an exemplary embodiment of the invention.

FIG. 6 illustrates the attachment of rings to the cover by non-elastic rope of a closure system according to an exemplary embodiment of the invention. The non-elastic rope 21 passes from underneath the cover 12 to outside the cover 12 through the grommet 19, which is fixed in or around a hole in the cover 12. The non-elastic rope 21 extends to and loops through the ring 20 back towards the grommet 19 such that both pieces of non-elastic rope 21 can be crimped together with a crimping material 23. The crimping material 23 may be constructed from any suitable material known in the art including, but not limited to, metal or plastic.

In some embodiments, the length of each non-elastic rope 21 and the location of each grommet 19 that each non-elastic rope 21 passes through is such that, when the rope 22 of the closure system 24 is interlaced and under tension, the grommets 19 on the lid component 16 and lateral component 18 are no less than about 5 cm from the vertical edges of the lid component 16, in other embodiments from about 5 cm to about 40 cm from one of the vertical edges of the lid component 16, in other embodiments from about 10 cm to about 30 cm from one of the vertical edges of the lid component 16, and in other embodiments from about 20 cm from one of the vertical edges of the lid component 16.

As described above, grommets 19 may be fixed in or around holes in the cover 12. The holes may be created by any suitable method known in the art, including, but not limited to, punching or drilling. The holes may be sized to any suitable diameter, including, but not limited to, about 12 mm. The cover 12 may include holes that are all the same size or that vary in size. The grommets 19 may also be sized to any suitable diameter. The cover 12 may include grommets 19 that are all the same size or that vary in size. In some embodiments, the internal diameter of the grommets 19 is the same size as the diameter of the holes in cover 12. In other embodiments, the internal diameter of the grommets 19 is smaller than the diameter of the holes in the cover 12.

The diameter of the non-elastic rope 21 may be any suitable diameter known in the art, including, but not limited to, from about 3 mm to about 15 mm. The non-elastic rope 21 may be constructed from any suitable material known in the art, including, but not limited to, polyethylene, polypropylene, polyester, nylon, polyurethane, natural or synthetic rubber, elastomers, aramid, natural and synthetic fibers such as sisal, jute, and the like, as well as steel, aluminum wire, etc.

Figure 7:
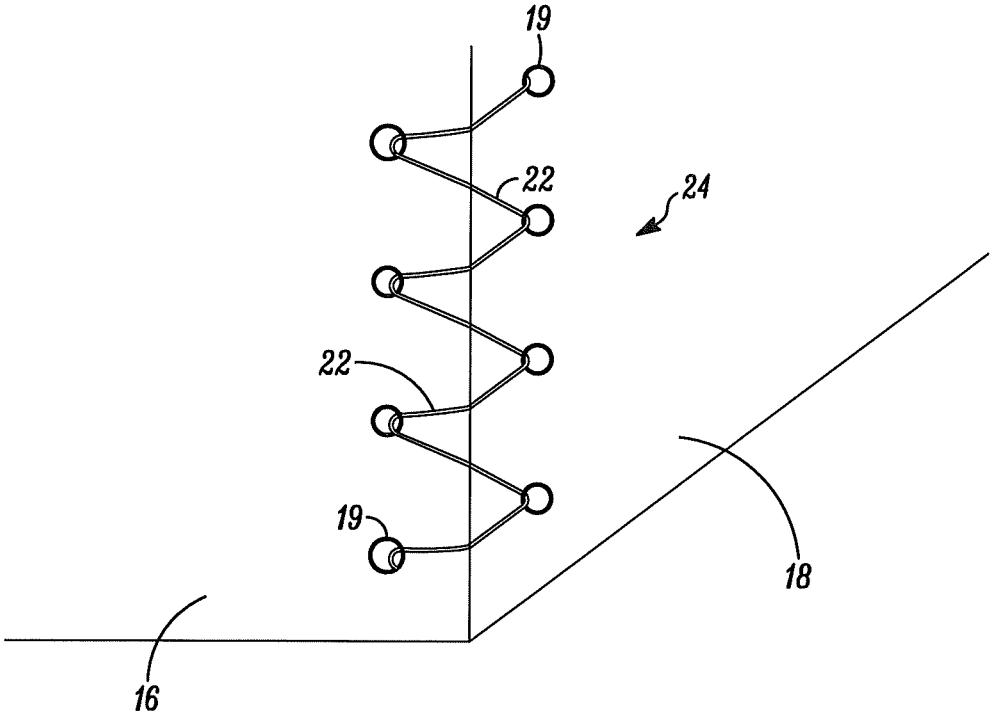
FIG. 7 shows a perspective view of a portion of a closure system along one opening at one vertical edge of a lid component with rope threaded through grommets according to an exemplary embodiment of the invention.

FIG. 7 illustrates a closure system along one opening at one vertical edge of a lid component with rope threaded through grommets according to an exemplary embodiment of the invention. The closure system 24 includes rope 22 that is threaded through the grommets 19 without the use of non-elastic rope 21 and rings 20 as described in embodiments above. The rope 22 is threaded through grommets 19 alternating between the lid component 16 and the lateral component 18 along one opening at one vertical edge of a lid component 16. In FIG. 7, the grommets are aligned side by side in the lid component 16 and the lateral component 18 such that the lid component 16 and the lateral component 18 each have a grommet 19 positioned approximately the same height from the bottom of the cover 12.

In some embodiments, the closure system 24 includes hook and loop fasteners that are fixed to the lid component 16 and the lateral component 18 for closing the openings that exist between the lid component 16 and the lateral component 18, and tightening the cover 12 around and against the cargo 14.

Materials

The cover may be any self-supporting sheet or cover such as porous or non-porous sheets or covers, preferably flexible sheets or covers, for example any fabric known in the fabric art, such as nonwoven, woven, knitted fabrics, membranes, microporous films, grids or a combination of two or more sheets or covers such as for example SMS (spunbonded-meltblown-spunbonded) laminates. The cover is preferably a nonwoven or woven fabric comprising one or more natural or synthetic (man-made) fibres or filaments. The natural fibers or filaments of the nonwoven or woven fabric can be chosen among cellulose, cotton, wool, silk, sisal, linen, flax, jute, kenaf, hemp, coconut, wheat, and rice and/or mixtures thereof. The synthetic (man-made) fibers or filaments of the non-woven or woven fabric can be chosen among polyamides, polyaramides, polyesters, polyimides, polyolefins, polyacrylates, poly(tetrafluoroethylene) and copolymers comprising tetrafluorethylene, other fluorinated copolymers and/or hybrids and mixtures thereof.

The material of the cover is preferably a polyolefin. The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene, and copolymers comprising various combinations of the monomers ethylene, propylene, and methylpentene.

The term "polyethylene" as used herein is intended to encompass not only homopolymers of ethylene, but also copolymers wherein at least 85% of the recurring units are ethylene units such as copolymers of ethylene and alpha-olefins. Preferred polyethylenes include low-density polyethylene, linear low-density polyethylene, and high-density polyethylene. A preferred high-density polyethylene has an upper limit melting range of about 130° C. to about 140° C., a density in the range of about 0.941 to 0.980 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers wherein at least 85% of the recurring units are propylene units. Preferred polypropylene polymers include isotactic polypropylene and syndiotactic polypropylene.

In some embodiments, the polyolefin cover is a nonwoven flash spun plexifilamentary sheet of polyethylene. Such sheets are available under the tradename TYVEK® from E. I. du Pont de Nemours and Company, Wilmington, DE The term "plexifilament" as used herein means a three-dimensional integral network or web of a multitude of thin, ribbon-like, film-fibril elements of random length. Typically, these have a mean film thickness of less than about 4 micrometers and a median fibril width of less than about 25 micrometers. The average film-fibril cross sectional area if mathematically converted to a circular area would yield an effective diameter between about 1 micrometer and about 25 micrometers. In plexifilamentary structures, the film-fibril elements intermittently unite and separate at irregular intervals in various places throughout the length, width and thickness of the structure to form a continuous three-dimensional network. Examples of plexifilamentary webs are those produced by the flash spinning processes described in U.S. Pat. No. 3,081,519 (Blades et al.), U.S. Pat. No. 3,169,899 (Steuber), U.S. Pat. No. 3,227,784 (Blades et al.), and U.S. Pat. No. 3,851,023 (Brethauer et al.), the contents of which are hereby incorporated by reference in their entirety.

In some embodiments, the polyolefin cover may also contain one or more additional layers, including, but not limited to, a metallic coating deposited on the side of the cover facing the product to be covered and/or an insulation material. For instance, examples of additional layers include, but are not limited to, those described in U.S. Pat. No. 9,839,873 (Rebouillat et al.), the contents of which are hereby incorporated by reference in their entirety.

The metallic coating may be any suitable metal known in the art for providing a chemically stable surface having a suitably low emissivity surface, including, but not limited to, gold, platinum, nickel, chromium, tin, zinc, silver, or aluminum, or alloys thereof. The thickness of the metallic coating may be less than 0.3 micrometers, more preferably less than 0.2 micrometers, and most preferably less than 0.1 micrometers.

The insulation material may be any suitable insulation material known in the art that is lightweight and flexible, including, but not limited to, polyester insulation fleece.

In some embodiments, the cover is a laminate of a metallized plexifilamentary flashspun polyethylene sheet with an insulation layer such as a polyester insulation fleece. An exemplary product of this type is Tyvek® 2563M, which has a nominal basis weight of about 330 gsm and a high solar reflectivity of at least 90% in the visible and near infra-red range—i.e., a visible range of 400 nm to 700 nm and a near infra-red range of 700 nm to 1100 nm—and the thermal fleece provides an R-value of about 0.3 m2K/W. In other embodiments, the cover is a laminate of a metallized plexifilamentary flashspun polyethylene sheet (without fleece). An exemplary product of this type is Tyvek® 3563M. In other embodiments, the cover is a laminate of a plexifilamentary flashspun polyethylene sheet (without fleece and metallization). An exemplary product of this type is Tyvek® 1560K.

Method of Utilizing a Protective Cover

Figure 8:
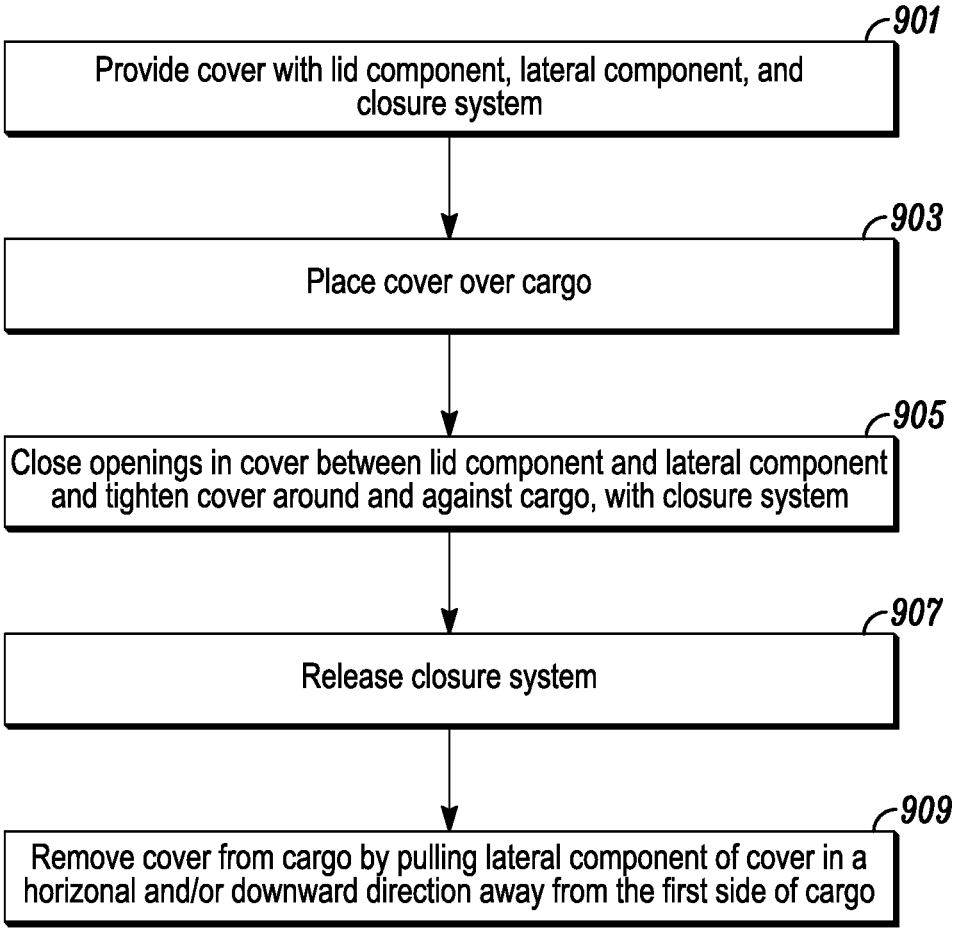
FIG. 8 is a flowchart of a method for protecting temperature sensitive goods according to an exemplary embodiment of the invention.

FIG. 8 illustrates a flowchart of a method of protecting temperature sensitive goods according to exemplary embodiments of the invention. In step 901, a cover 12 is provided comprising a lid component 16, a lateral component 18, and a closure system 24, as described in the embodiments above.

In step 903, the cover 12 is placed over the cargo or product 14.

In step 905, the closure system 24 closes openings in the cover 12 between the lid component 16 and lateral component 18 that exist along both vertical edges of lid component sections 16*b* and 16*c*, and tightens the cover 12 around and against the cargo 14. This may be done in a variety of different ways depending on the type of the closure system 24 used. For instance, as described in more detail in the embodiments above, a closure system 24 on both edges of the lid component 16 may include, but is not limited to, (i) a rope 22 threaded through a plurality of rings 20 attached to the cover 12 by a non-elastic rope 21, (ii) a rope 22 threaded through grommets 19, or (iii) hook and loop fasteners. By way of example, if the closure system 24 includes a rope 22 to be threaded through a plurality of rings 20 attached to the cover 12 by a non-elastic rope 21, closing the openings and tightening the cover 12 occurs by first attaching the top end of the rope 22 to the topmost ring 20 in the closure system 24 along one vertical edge of lid component sections 16*b* and 16*c*. The top end of the rope 22 may include a carabiner that can be used to secure the rope 22 to the topmost ring 20 in the cover 12. The rope 22 may then be alternately threaded through the rings 20 between lid component 16 and the lateral component 18 from top to bottom. The rope 22 may then be tensioned throughout the rings 20 by pulling on the rope 22 and locking the bottom end of the tensioned rope 22 to the bottommost ring 20 in the cover 12. The bottom end of the tensioned rope 22 may include a carabiner that can be used to secure the tensioned rope 22 to the bottommost ring 20 in the cover 12. These steps may then be repeated on the closure system 24 along the opening at the opposite vertical edge of lid component sections 16*b* and 16*c*.

In step 907, the closure system 24 is released along the openings in the cover 12 that exist along both vertical edges of lid component sections 16*b* and 16*c*. By way of example, if the closure system 24 includes a tensioned rope 22 threaded through a plurality of rings 20 attached to the cover 12 by non-elastic ropes 21, releasing the closure system 24 occurs by first detaching the bottom end of the rope 22 from the bottommost ring 20 in the closure system 24 along one vertical edge of lid component sections 16*b* and 16*c*. The rope 22 may then be unthreaded through the rings 20 that are easily reachable by the operator. The lid component 16 and lateral component 18 may then be pulled apart, at least partially, to open the cover 12 as much as possible. These steps may then be repeated on the closure system 24 along the opening at the opposite vertical edge of lid component sections 16*b* and 16*c*.

In step 909, the cover 12 is removed from the product by pulling the lateral component 18 of the cover 12 in a horizontal and/or downward direction away from the first side of the cargo 14.

It will be apparent to one skilled in the relevant art(s) that the cover 12 described above may include additional features designed to facilitate the safe and ergonomic use of the cover 12 in various environments such as ground handling environments. Such additional features may include, but are not limited to: labels providing instructions, alignment information or safety warnings; handles, straps, or similar means to facilitate manipulation of the cover; hooks, clamps, or similar means to allow the cover 12 to be easily secured to an airline pallet, these being either attached to the bottom edge of the cover 12 or at a position further up the sides of the cover 12 such as by means of an elastic rope or bungee; or a bag or pouch into which the cover 12 may be packed for transport on the airfield and for storage, which may be a separate accessory or integrated into the structure of the cover 12.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. Thus, it should be appreciated that, while the invention has been described with reference to the above exemplary embodiments, other embodiments are within the scope of the claims. Moreover, it should be understood that the exemplary embodiments described above may be combined to form other embodiments. After reading the above description, it will be apparent to one skilled in the relevant art(s) how to implement the invention in alternative embodiments. Thus, the present invention should not be limited by any of the above-described exemplary embodiments.

What is claimed as new and desired to be protected by Letters Patent of the United States is:

1. A system adapted for protecting temperature sensitive products comprising:

a cover that is adapted to fit over a product, the cover having a first component, a second component, and a closure system;

wherein the first component is adapted to cover a top of the product and at least a portion of a first side of the product, and the second component is adapted to cover at least a portion of a second side of the product, at least a portion of a third side of the product, and at least a portion of a fourth side of the product;

wherein the closure system is adapted to close openings between the first component and the second component and is adapted to tighten the cover around the product and wherein the closure system is positioned along a first opening at one vertical edge of the first component and along a second opening at another vertical edge of the first component;

wherein the first component comprises a top section, a front section extending from a front side of the top section, a rear flap extending from a rear side of the top section, a left side flap extending from a left side of the top section, and a right side flap extending from a right side of the top section, wherein the second component includes a rear section, a left side section, and a right side section, wherein the rear flap of the first component overlaps and is fixed to the rear section of the second component, wherein the left side flap of the first component overlaps and is fixed to the left side section of the second component, wherein the right side flap of the first component overlaps and is fixed to the right side section of the second component, wherein the front section of the first component is adapted to be secured, using the closure system, to the left and right side sections of the second component, and wherein, independently of the closure system, the first component and the second component are fixed permanently to one another at points between or at a seam of the overlap; and wherein the first component and the second component are removable from the product by releasing the closure system and pulling the second component of the cover in a horizontal or downward direction away from the first side of the product.

2. The system of claim 1, wherein the first component is adapted to cover the entire first side of the product and the second component is adapted to cover the entire other sides of the product.

3. The system of claim 1, wherein the first side of the product contains a contoured edge and wherein the first component is correspondingly contoured to cover the contoured edge.

4. The system of claim 1, wherein the closure system along the first opening includes a first rope alternately threaded in a zigzag-like pattern between first rings positioned on the first component and on the second component, and the closure system along the second opening includes a second rope alternately threaded in a zigzag-like pattern between second rings positioned on the first component and on the second component.

5. The system of claim 4, wherein the first rings are spaced apart vertically and include a top 25%, as positioned vertically, and a bottom 25%, as positioned vertically, wherein the second rings are spaced apart vertically, and include a top 25%, as positioned vertically, and a bottom 25%, as positioned vertically, wherein at least some of the top 25%, as positioned vertically, of the first rings and the bottom 25%, as positioned vertically, of the first rings are spaced closer together vertically than the other first rings, and wherein at least some of the top 25%, as positioned vertically, of the second rings and a bottom 25%, as positioned vertically, of the second rings are spaced closer together vertically than the other second rings.

6. The system of claim 4, wherein the first rings and the second rings are attached to the cover with non-elastic ropes that pass through grommets placed in or around holes in the first component and the second component.

7. The system of claim 6, wherein the length of each non-elastic rope and the location of each grommet that each non-elastic rope passes through is such that, when the first rope and the second rope of the closure system are interlaced and under tension, the grommets are no less than about 5 cm from the one vertical edge of the first component and the other vertical edge of the first component.

8. The system of claim 4, wherein each of the first rope and the second rope comprises a non-elastic section and an elastic section, the elastic section being located within the bottom 30% of the first rope and within the bottom 30% of the second rope.

9. The system of claim 1, wherein the first component and the second component of the cover have a nominal basis weight of no greater than about 600 gsm.

10. The system of claim 1, wherein the cover has a total weight of less than about 35 kg.

11. The system of claim 1, wherein the first component and the second component comprise a polyolefin.

12. The system of claim 11, wherein the polyolefin is a nonwoven flash spun plexifilamentary sheet of polyethylene.

13. The system of claim 12, wherein the first component and the second component have a solar reflectivity of at least 90% of visible and near infra-red radiation.

14. The system of claim 12, wherein the first component and the second component of the cover further comprise a layer of fleece with an R-value of about 0.3 m2K/W.

15. The system of claim 1, wherein the first component comprises a top section and a front section that are integrally formed, and wherein the second component comprises a rear section, a left side section, and a right side section that are integrally formed.

16. A system adapted for protecting temperature sensitive products comprising:

a cover that is adapted to fit over a product, the cover having a first component, a second component, and a closure system;

wherein the first component is adapted to cover a top of the product and at least a portion of a first side of the product, and the second component is adapted to cover at least a portion of other sides of the product;

wherein the first component comprises a top section and a front section that are integrally formed, and wherein the second component comprises a rear section, a left side section, and a right side section that are integrally formed;

wherein the first component further comprises a rear flap, a left side flap, and a right side flap, wherein the second component further comprises a first front flap extending from the left side section and a second front flap extending from the right side section, wherein the rear flap of the first component overlaps and is permanently fixed to the rear section of the second component, wherein the left side flap of the first component overlaps and is permanently fixed to the left side section of the second component, wherein the right side flap of the first component overlaps and is permanently fixed to the right side section of the second component, and wherein the front section of the first component is adapted to overlap and to be secured, using the closure system, to each of the first front flap and the second front flap of the second component;

wherein the closure system is adapted to close openings between the first component and the second component and is adapted to tighten the cover around the product;

wherein, independently of the closure system, the first component and the second component are fixed to one another;

wherein the first component and the second component are removable from the product by releasing the closure system and pulling the second component of the cover in a horizontal or downward direction away from the first side of the product.

17. The system of claim 16, wherein the front section of the first component includes at least a first part and a second part, wherein the first part and the second part are oriented differently relative to the top section.

18. The system of claim 16, wherein each of the first component and the second component comprises a nonwoven fabric.

19. The system of claim 18, wherein the nonwoven fabric is a nonwoven flash spun plexifilamentary sheet of polyethylene.

20. The system of claim 19, wherein at least one of the first component and the second component further comprises at least one of a metallic coating and insulation material.

21. The system of claim 16, wherein the closure system comprises a first rope, a first plurality of rings, a second plurality of rings, a second rope, a third plurality of rings, and a fourth plurality of rings, wherein the first plurality of rings are located on the front section of the first component proximate to a left vertical edge of the front section of the first component, wherein the second plurality of rings are located on the left side section of the second component proximate to the first front flap, wherein the first rope is alternately threaded in a zigzag-like pattern between the first plurality of rings and the second plurality of rings, wherein the third plurality of rings are located on the front section of the first component proximate to a right vertical edge of the front section of the first component, wherein the fourth plurality of rings are located on the right side section of the second component proximate to the second front flap, and wherein the second rope is alternately threaded in a zigzag-like pattern between the third plurality of rings and the fourth plurality of rings.

22. The system of claim 21 wherein the closure system further comprises a first plurality of openings, a second plurality of openings, a third plurality of openings, a fourth plurality of openings, and a plurality of ropes, wherein the first plurality of openings are provided in the front section of the first component proximate to the first plurality of rings, wherein the second plurality of openings are provided in the left side section of the second component proximate to the second plurality of rings, wherein the third plurality of openings are provided in the front section of the first component proximate to the third plurality of rings, wherein the fourth plurality of openings are provided in the right side section of the second component proximate to the fourth plurality of rings, and wherein individual ropes of the plurality of ropes couple each of the first plurality of rings to a corresponding one of the first plurality of openings, each of the second plurality of rings to a corresponding one of the second plurality of openings, each of the third plurality of rings to a corresponding one of the third plurality of openings, and each of the fourth plurality of rings to a corresponding one of the fourth plurality of openings.

23. A system adapted for protecting temperature sensitive products comprising:

a cover that is adapted to fit over a product, the cover having a first component, a second component, and a closure system;

wherein the first component is adapted to cover a top of the product and at least a portion of a first side of the product, and the second component is adapted to cover at least a portion of a second side of the product, at least a portion of a third side of the product, and at least a portion of a fourth side of the product;

wherein the closure system is adapted to close openings between the first component and the second component and is adapted to tighten the cover around the product and wherein the closure system is positioned along a first opening at one vertical edge of the first component and along a second opening at another vertical edge of the first component;

wherein at least one of the first component and the second component includes flaps that create an overlap between the first component and the second component and wherein, independently of the closure system, the first component and the second component are fixed permanently to one another at points between or at a seam of the overlap;

wherein the first component is a lid component and the second component is a lateral component, wherein the lid component comprises a first flap, a second flap, and a third flap, wherein the first flap of the lid component overlaps and is permanently fixed to a first side of the lateral component, wherein the second flap of the lid component overlaps and is permanently fixed to a second side of the lateral component, and wherein the third flap of the lid component overlaps and is permanently fixed to a third side of the lateral component; and wherein the first component and the second component are removable from the product by releasing the closure system and pulling the second component of the cover in a horizontal or downward direction away from the first side of the product.

24. The system of claim 23, wherein the first component and the second component have a solar reflectivity of at least 90% of visible and near infra-red radiation.

* * * * *